US010166802B2

(12) United States Patent
Yuno et al.

(10) Patent No.: US 10,166,802 B2
(45) Date of Patent: Jan. 1, 2019

(54) STAMP-FACE PLATEMAKING DEVICE, MEDIUM HOLDER, AND MEDIUM HOLDER MANUFACTURING METHOD

(71) Applicant: CASIO COMPUTER CO., LTD., Shibuya-ku, Tokyo (JP)

(72) Inventors: Hirotaka Yuno, Hiratsuka (JP); Takayuki Hirotani, Akiruno (JP); Yasushi Murai, Ome (JP); Shigeru Futawatari, Ome (JP); Takanori Suzuki, Kodaira (JP); Yoshimasa Yokoyama, Hachioji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 220 days.

(21) Appl. No.: 14/490,341

(22) Filed: Sep. 18, 2014

(65) Prior Publication Data

US 2015/0084256 A1 Mar. 26, 2015

(30) Foreign Application Priority Data

Sep. 20, 2013 (JP) ..... 2013-195407

(51) Int. Cl.
*B25B 1/00* (2006.01)
*B41K 3/00* (2006.01)
(Continued)

(52) U.S. Cl.
CPC ..... *B41K 3/00* (2013.01); *B41J 3/407* (2013.01); *B41K 1/50* (2013.01); *B41C 3/00* (2013.01); *Y10T 29/49826* (2015.01)

(58) Field of Classification Search
USPC ..... 269/86
See application file for complete search history.

(56) References Cited

U.S. PATENT DOCUMENTS 4,000,243 A * 12/1976 Curren ..... B41C 3/06 264/293
4,602,778 A * 7/1986 Hirose ..... G03B 27/625 271/227
(Continued)

FOREIGN PATENT DOCUMENTS

JP 03247474 A 11/1991
JP 10100464 A 4/1998
(Continued)

OTHER PUBLICATIONS

Related U.S. Appl. No. 14/490,388; First Named Inventor: Hirotaka Yuno; Title: "Stamp-Face Platemaking Device, Medium Holder, and Medium Holder Manufacturing Method"; Filed: Sep. 18, 2014.

*Primary Examiner* — Tyrone V Hall, Jr.
(74) *Attorney, Agent, or Firm* — Holtz, Holtz & Volek PC

(57) ABSTRACT

A stamp-face platemaking device transports a medium holder inserted into a plate insertion portion to a printing unit. The medium holder holds a stamp face material in a plate-like member, and has a predetermined pattern in a side end portion thereof. An optical sensor detects the top end portion of the medium holder on a sensor scanning line in the inserting direction, and the pattern start point and the pattern end point of the predetermined pattern. At least one of the horizontal and vertical sizes of the stamp face material is set based on the positions of two of the detected end portions. When the pattern end point is detected, platemaking with the stamp face material is started.

7 Claims, 7 Drawing Sheets

(51) Int. Cl.

| | |
|---|---|
| ***B41J 3/407*** | (2006.01) |
| ***B41K 1/50*** | (2006.01) |
| *B41C 3/00* | (2006.01) |

(56) References Cited

U.S. PATENT DOCUMENTS

| | | | | | |
|---|---|---|---|---|---|
| 4,635,548 | A * | 1/1987 | Pensky | B41K 3/00 | 101/319 |
| 5,285,725 | A * | 2/1994 | Imamaki | B41N 1/248 | 101/127.1 |
| 5,483,880 | A * | 1/1996 | Seo | B41K 1/32 | 101/125 |
| 5,595,112 | A * | 1/1997 | Seo | B41K 1/32 | 101/125 |
| 5,829,352 | A * | 11/1998 | Taira | B41K 1/04 | 101/125 |
| 5,858,298 | A * | 1/1999 | Humal | B23K 26/18 | 264/321 |
| 6,276,272 | B1 * | 8/2001 | Takami | B41K 1/50 | 101/327 |
| 6,341,561 | B1 * | 1/2002 | Imamaki | B41K 1/02 | 101/327 |
| 6,367,382 | B1 * | 4/2002 | Imamaki | B41C 3/06 | 101/333 |
| 6,460,456 | B1 * | 10/2002 | Sugiyama | B41D 7/00 | 101/327 |
| 7,581,806 | B2 | 9/2009 | Niioka | | |
| 9,302,520 | B2 * | 4/2016 | Oshima | B41K 3/00 | |
| 2014/0020584 | A1 * | 1/2014 | Abe | B41K 1/00 | 101/333 |

FOREIGN PATENT DOCUMENTS

| | | | |
|---|---|---|---|
| JP | 2001010016 | A | 1/2001 |
| JP | 2001113809 | A | 4/2001 |
| JP | 2006095810 | A | 4/2006 |
| JP | 2007136803 | A | 6/2007 |
| JP | 2011020293 | A | 2/2011 |
| JP | 2013163342 | A | 8/2013 |

* cited by examiner

STAMP-FACE PLATEMAKING DEVICE, MEDIUM HOLDER, AND MEDIUM HOLDER MANUFACTURING METHOD

CROSS-REFERENCE TO RELATED APPLICATION

This application claims benefit of priority of Japanese Patent Application No. 2013-195407, filed on Sep. 20, 2013. The entire contents of Japanese Patent Application Nos. 2013-195407, filed on Sep. 20, 2013 and 2013-136947, filed on Jun. 28, 2013 are incorporated by reference herein.

BACKGROUND OF THE INVENTION

Field of the Invention

The present invention relates to a medium holder inserted into a stamp-face platemaking device so as to perform appropriate platemaking, the stamp-face platemaking device that accurately detects the size of the stamp face material held in the medium holder, and a medium holder manufacturing method.

Description of the Prior Art

Stamps each having sponge rubber as a stamp material that is impregnated beforehand with ink have been used to avoid trouble of applying ink to the face of a stamp every time a stamp mark is placed with the stamp.

For example, JP 10-100464 A discloses a manufacturing device that secures a stamp having a base, to which a stamp plate (a stamp face material) formed with a porous sheet is attached, onto a platemaking device, presses a thermal head against the surface of the porous sheet to move the stamp plate, selectively heats the heating element of the thermal head, and forms a stamp face on the stamp plate, the stamp face being formed with a melted and solidified portion that blocks ink and an unmelted portion through which ink passes.

However, the technique disclosed in JP 10-100464 A uses a carriage in the drive mechanism for the thermal head, and a mechanism that drives a thermal head with a carriage has a large-sized structure and does not satisfy the demand for smaller devices in the recent market.

Also, as is apparent from FIG. 4 of JP 10-100464 A, an edge head is used as the thermal head. The price of an edge head is almost three times higher than the price of a conventional head. This leads to a problem of a large increase in cost, in addition to the above described problem of an increase in device size.

Further, JP 10-100464 A discloses the sizes of the heating element in the main scanning direction and the sub scanning direction, but does not disclose the size of the stamp plate to be used in platemaking. As the stamps shown in FIGS. 1, 4, and 5 have different shapes, it is only possible to assume that there are stamp bases of various sizes, and stamp plates to be secured to stamp bases also vary in size.

Also, by the technique disclosed in JP 10-100464 A, the size of a stamp face material cannot be sensed from the platemaking device simply by printing the size of the stamp face material on the medium holder holding the stamp face material. Therefore, it is left to the user to determine whether the size of the stamp face material is correct. In a case where the user inadvertently inserts a medium holder holding a stamp face material of a different size from a desired stamp size into a platemaking device, not only does the platemaking fail, but also the stamp face material and the medium holder are discarded and wasted.

SUMMARY OF THE INVENTION

The present invention is to solve the above problems, and aims to provide a stamp-face platemaking device that accurately detects the size of a stamp face material held in a medium holder inserted into the stamp-face platemaking device so as to perform appropriate platemaking, a method of detecting the size of the stamp face material, the medium holder, and a method of manufacturing the medium holder.

To solve the above problems, a stamp-face platemaking device of the present invention includes: a plate insertion portion; a pattern detecting unit that detects respective positions of a top end portion of a medium holder on a sensor scanning line in an inserting direction, one pattern end portion of a predetermined pattern, and the other pattern end portion of the predetermined pattern when the medium holder holding a stamp face material and having the predetermined pattern formed in a side end portion thereof is inserted into the plate insertion portion; and a size setting unit that sets a size of the stamp face material in the inserting direction and/or a size of the stamp face material in a direction perpendicular to the inserting direction based on the positions of at least two end portions among the top end portion on the sensor scanning line, the one pattern end portion, and the other pattern end portion detected by the pattern detecting unit.

To solve the above problems, a medium holder of the present invention includes a holding unit that detachably holds a stamp face material formed with a porous sponge material that can be impregnated with ink, the holding unit having a predetermined pattern formed in a side end portion thereof.

To solve the above problems, a medium holder manufacturing method of the present invention includes the steps of: forming a predetermined pattern on a holding unit for holding a stamp face material in a detachable manner; forming the holding unit by cutting; and placing the stamp face material on the holding unit.

DESCRIPTION OF THE PREFERRED EMBODIMENTS

The following is a detailed description of embodiments of the present invention, with reference to the accompanying drawings.

First Embodiment

Figure 1:
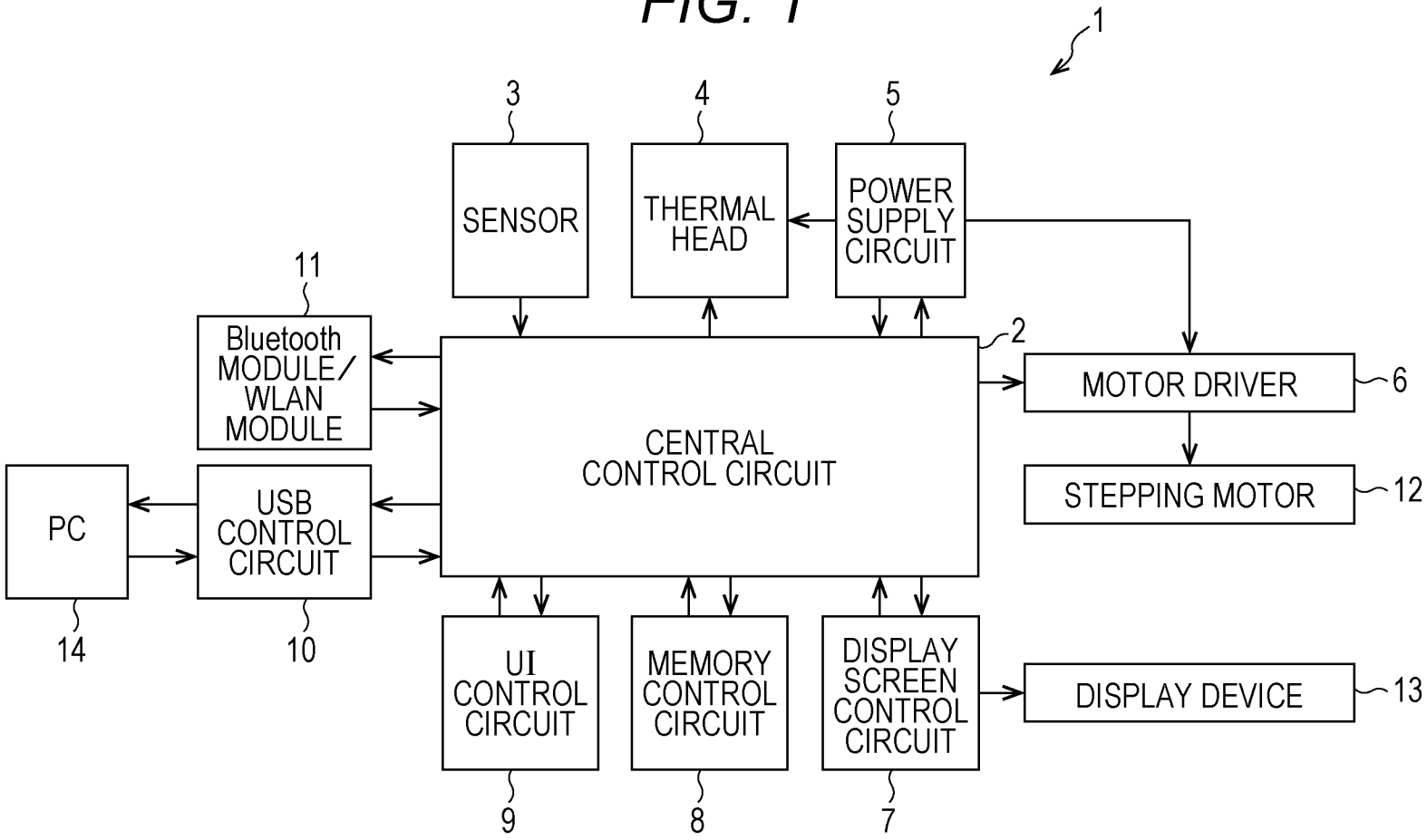
FIG. 1 is a block diagram of the system configuration of a plate-making thermal printer that performs appropriate platemaking by detecting the size of the stamp face material of a medium holder according to a first embodiment of the present invention.

FIG. 1 is a block diagram of a system configuration of a plate-making thermal printer (hereinafter referred to simply as the printer) that performs appropriate platemaking by detecting the size of the stamp face material of a medium holder according to a first embodiment of the present invention.

As shown in FIG. 1, a printer 1 includes a central control circuit 2, and the central control circuit 2 includes a sensor 3, a thermal head 4, a power supply circuit 5, a motor driver 6, a display screen control circuit 7, a memory control circuit 8, a UI (user interface) control circuit 9, a USB control circuit 10, and a Bluetooth module/wireless LAN module 11.

A stepping motor 12 is connected to the motor driver 6, a display device 13 is connected to the display screen control circuit 7, and a PC (personal computer) 14 is connected to the USB control circuit 10.

It should be noted that the sensor 3 is formed with a reflective optical sensor in this example. The display device 13, the display screen control circuit 7, the UI control circuit 9, the USB control circuit 10, and the Bluetooth module/wireless LAN module 11 are not necessarily provided in the printer 1.

In FIG. 1, the central control circuit 2 controls the entire system. Although almost all the circuits are connected only to the central control circuit 2 in this drawing, the circuits can of course perform data communications with one another via a bus. The central control circuit 2 is a circuit that includes a CPU (central processing unit), and realizes a later described unit (such as a transportation distance detecting unit, a size setting unit, a size determining unit, or a position detecting unit) as the CPU reads and executes a computer program as necessary.

The memory control circuit 8 includes devices such as a ROM (read only memory) and a RAM (random access memory), and controls these devices. The display device 13 is a display device such as an LCD (liquid crystal display), and the display screen control circuit 7 controls data transfers to the display device 13, switching on and off of the backlight, and the like.

The respective correspondence tables described later are stored in the ROM or the like, and are written into the RAM for reference and use, where necessary. Driver software is installed into the personal computer, so that the stamp-face platemaking device operates in cooperation through a USB connection or the like. Accordingly, the correspondence tables may not be stored in the stamp-face platemaking device, but may be stored in the personal computer.

For example, in a case where the device needs to be connected or wirelessly connected to the PC 14, the user operates on the GUI (Graphical User Interface) of the PC 14 or a portable telephone device or the like (not shown), and therefore, the display screen control circuit 7 and the display device 13 are not necessarily provided in the hardware.

The UI control circuit 9 controls the menu screen display and the like based on information that is input through an input device such as a keyboard and a mouse, a remote controller and buttons, or a touch panel. The power supply circuit 5 is formed with a power supply IC (integrated circuit) and the like, and generates and supplies power sources necessary to the respective circuits.

The thermal head 4 receives data and a print signal that are output from the central control circuit 2, controls energized dots with a driver IC provided in the head, and performs printing (platemaking or printing, which applies in the description below) on a stamp face material such as porous ethylene-vinyl acetate copolymer (hereinafter referred to as EVA) in contact with the head.

In this example system configuration, the other circuits receive only data and signals from the central control circuit 2, and the power necessary for printing is obtained from the power supply circuit 5. In the device of this example, the thermal head 4 has a resolution of 200 dots/25.4 mm, and a valid print width of 48 mm.

The motor driver 6 is a drive circuit that drives the stepping motor 12, receives signals output from the central control circuit 2, and supplies a pulse signal and power for driving to the stepping motor 12. It should be noted that only an excitation signal is received from the central control circuit 2, and actual drive power is obtained from the power supply circuit 5.

The central control circuit 2 can accurately recognize how many times the stepping motor 12 is rotated or how many millimeters the printing medium (the later described medium holder in this example) is transported, by counting the number of pulses of signals output to the motor driver 6.

The printer 1 in this example performs 1-2 phase excitation driving, and is designed so that the gear ratio becomes 16 steps per one line (0.125 mm). That is, 0.0078-mm transportation is performed in one step.

Figure 2:
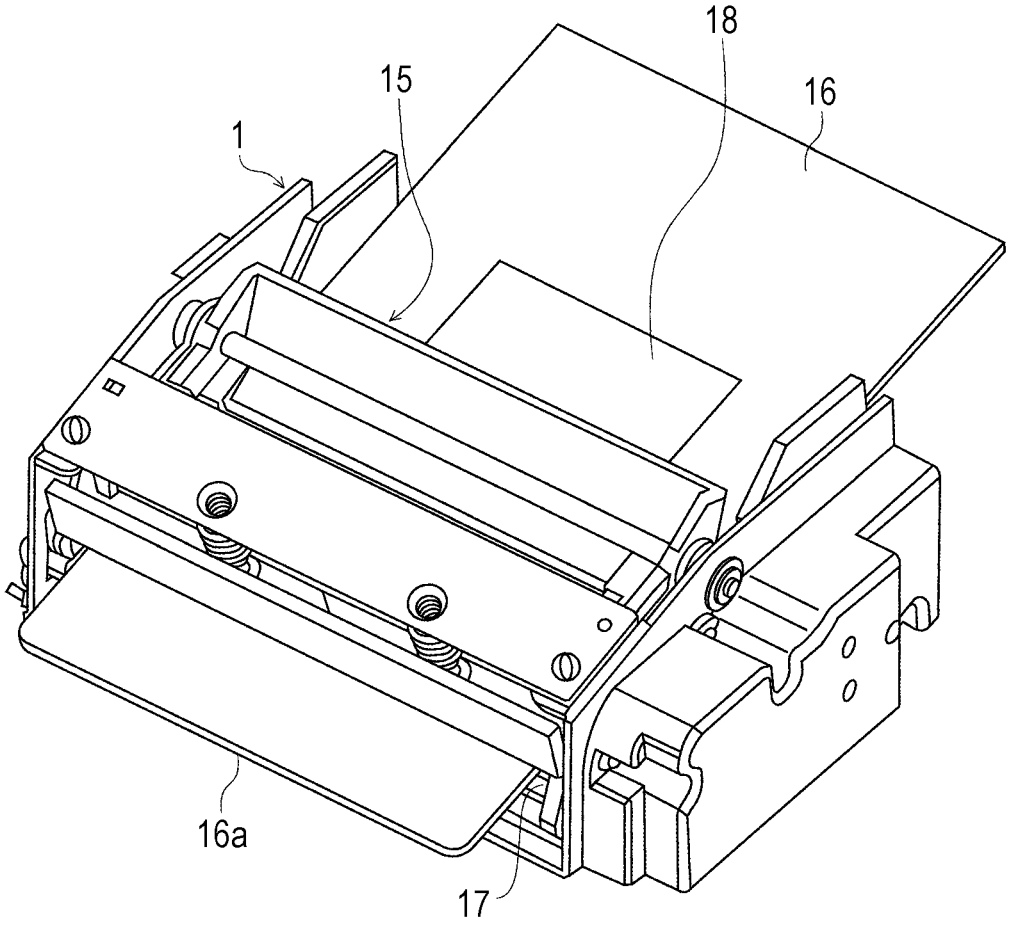
FIG. 2 is an external perspective view of the plate-making thermal printer with a medium holder according to the first embodiment.

FIG. 2 is an external perspective view of the printer 1 with a medium holder. In FIG. 2, a medium holder 16 is inserted into the printing medium inlet (plate insertion portion) 15 of the printer 1, and the top end 16*a* sticks out of the outlet 17. The medium holder 16 holds a stamp face material 18.

Figure 3A:
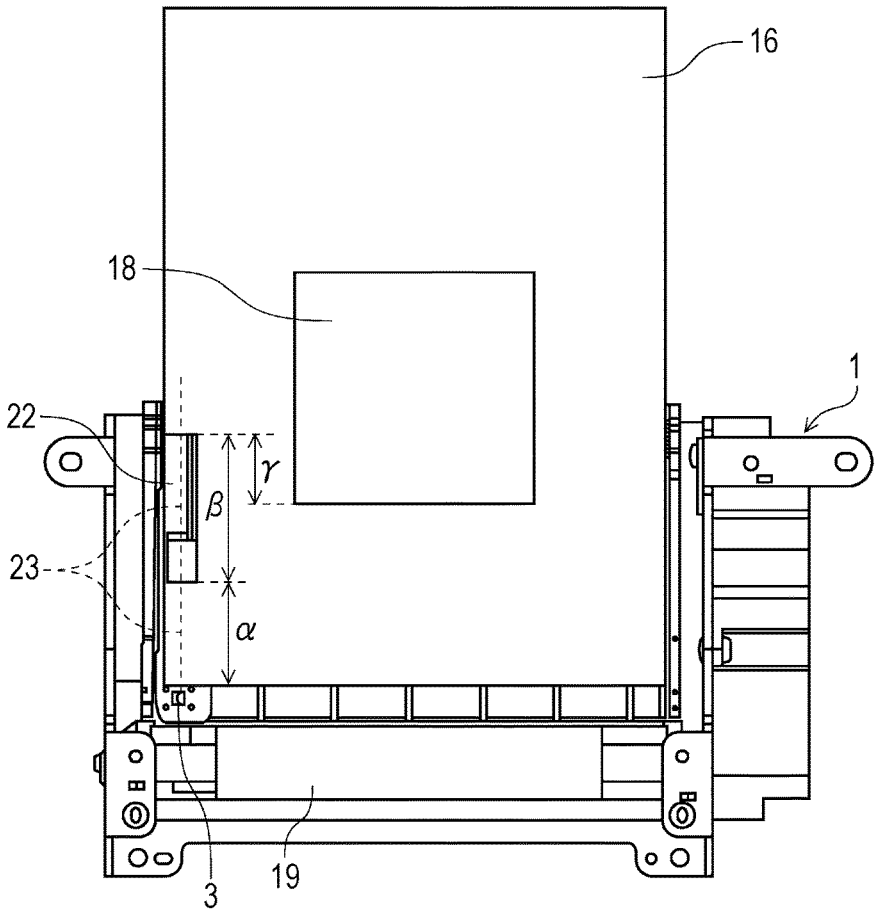
FIG. 3A is a plan view of the structure shown in FIG. 2.
Figure 3B:
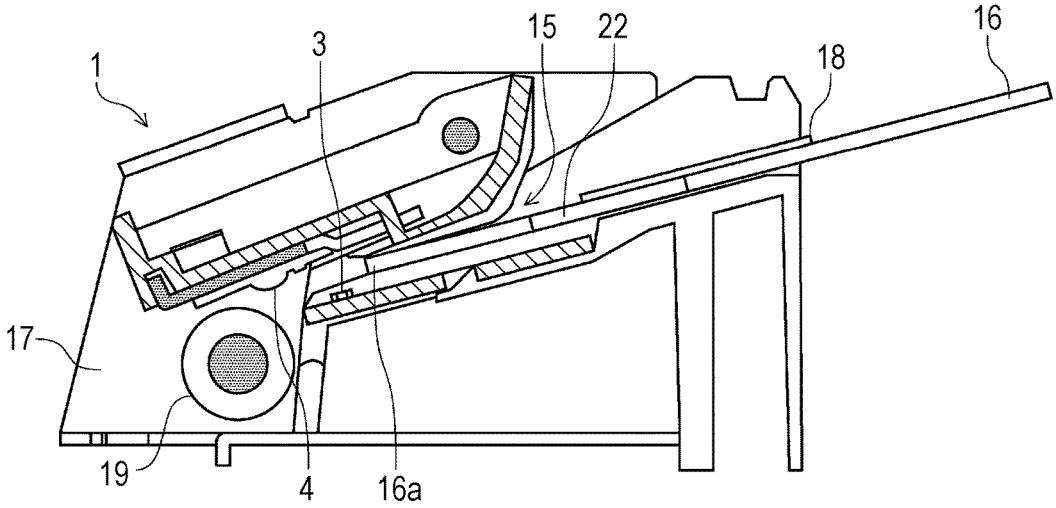
FIG. 3B is a cross-sectional side view of the structure shown in FIG. 3A.

FIG. 3A is a plan view of the structure shown in FIG. 2, and FIG. 3B is a cross-sectional side view of the structure shown in FIG. 3A. FIGS. 3A and 3B illustrate a situation that is seen immediately after the medium holder 16 is inserted into the printing medium inlet 15 of the printer 1. The top end 16*a* of the medium holder 16 is inserted to reach a point in the vicinity of the position of the sensor 3. The thermal head 4 and a platen roller 19 are placed ahead of the transportation path.

Figure 4A:
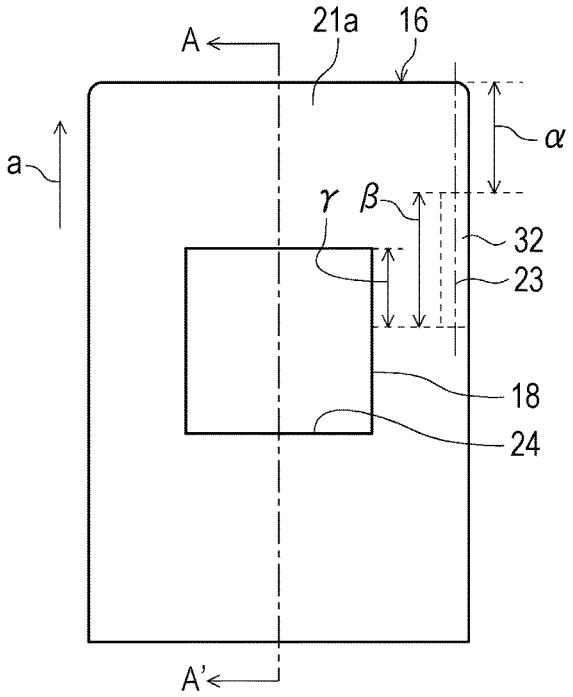
FIG. 4A is a plan view of the medium holder holding a stamp face material.
Figure 4B:
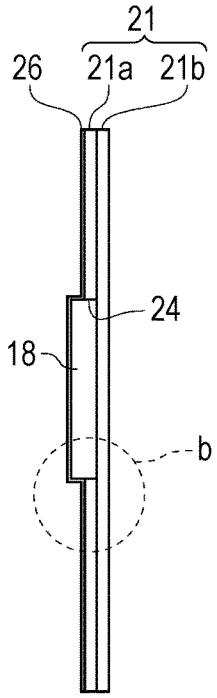
FIG. 4B is a cross-sectional view of the structure shown in FIG. 4A, taken along the A-A' line.
Figure 4C:
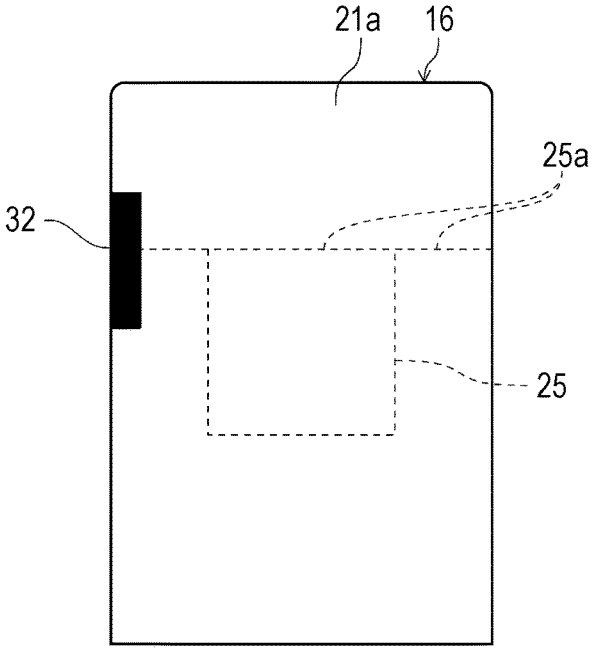
FIG. 4C is a back view of the structure shown in FIG. 4A.

FIG. 4A is a plan view of the medium holder 16 holding the stamp face material 18, FIG. 4B is a cross-sectional view of the medium holder 16 taken along the line A-A', and FIG. 4C is a back view of the medium holder 16 shown in FIG. 4A.

As shown in FIGS. 4A and 4B, the medium holder 16 holds the stamp face material 18 secured in one position. The arrow "a" shown in FIG. 4A indicates the transporting direction of the medium holder 16 in the printer 1.

This medium holder 16 is formed by bonding two pieces of cardboard 21 (an upper cardboard sheet 21*a* and a lower cardboard sheet 21*b*) formed with coated cardboard. A predetermined pattern 32 is formed in conformity with the position to be detected by the sensor 3 on one side (the right side in FIG. 4A) of the medium holder 16 (also see FIG. 3A). The predetermined pattern 32 is a rectangular solid-black portion printed on the back surface of the medium holder 16 in this example, but may be any pattern, design, or figure, as long as the start and the end thereof can be detected by the sensor 3.

The printer 1 detects this predetermined pattern 32 with the use of the sensor 3 along a sensor scanning line 23 indicated by a dot-and-dash line, to identify the horizontal and vertical size of the stamp face material 18 and the position of the start of printing (or platemaking, as in the description below), which will be described later in detail.

A positioning hole 24 for positioning and securing the stamp face material 18 is formed in the upper cardboard sheet 21*a*. The lower portion of the stamp face material 18 is put into the positioning hole 24 so as to be positioned and secured.

The upper surface of the stamp face material 18 is designed to slightly protrude from the upper surface of the upper cardboard sheet 21*a*. In this example, while the thickness of the stamp face material 18 is 1.5 mm, the thickness of the upper cardboard sheet 21*a* is 0.79 mm.

This is to enable the thermal head 4 to conduct stable platemaking control by performing a heat treatment (printing or platemaking) while slightly crushing the EVA of the stamp face material 18.

The lower cardboard sheet 21*b* is designed to have the same contour as the upper cardboard sheet 21*a*, and have an entirely flat inner surface. The lower cardboard sheet 21*b* and the upper cardboard sheet 21*a* are integrated by bonding, and the lower cardboard sheet 21*b* is in contact with the lower surface of the stamp face material 18, to hold the stamp face material 18 from below.

As shown in FIG. 4C, the lower cardboard sheet 22*b* has perforation 25 formed along the positioning hole 24 shown in FIG. 4A. The upper portion of the perforation 25 forms perforation 25*a* extending to both side end portions of the lower cardboard sheet 22*b*.

The stamp face material 18 held by the medium holder 16 is formed with a porous sponge material that can be impregnated with ink. The sponge material may be ethylene-vinyl acetate copolymer, for example.

As shown in FIG. 4B, the surface of the upper cardboard sheet 21*a* and the surface and side surfaces of the stamp face material 18 exposed through the positioning hole 24 of the upper cardboard sheet 21*a* are covered with a film 26.

The film 26 contains PET (Polyethylene Terephthalate) or polyimide or the like as its base material, and the base material has heat resistance, heat conductivity, and surface smoothness. As for heat resistance, the base material has resistance to higher temperatures than the melting point of the stamp face material 18.

Figure 5:
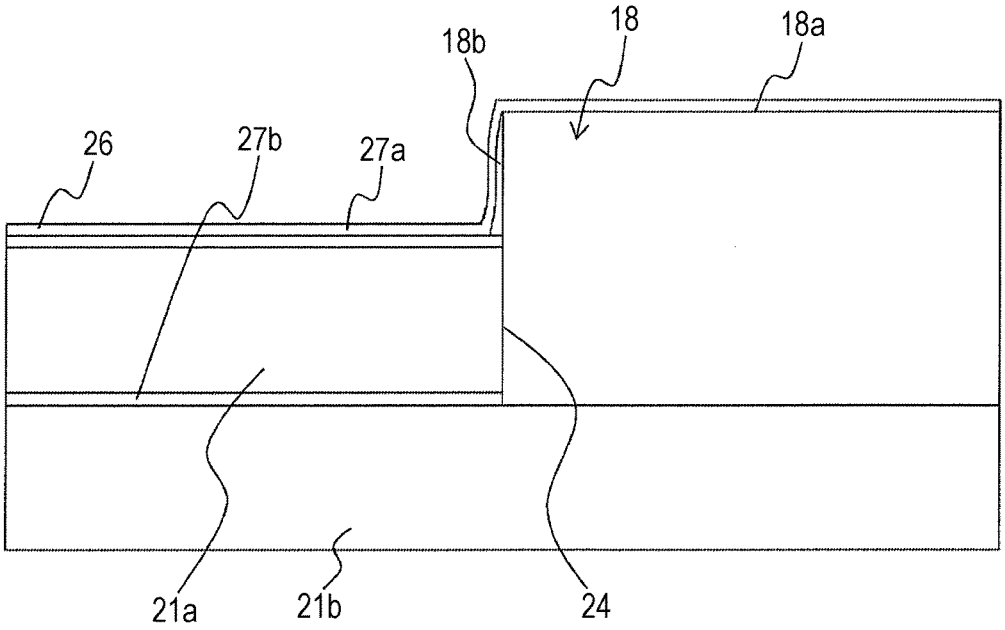
FIG. 5 is an enlarged view of the portion surrounded by a circle b drawn with a dashed line in FIG. 4B.

FIG. 5 is an enlarged view of the portion surrounded by a circle b drawn with a dashed line in FIG. 4B. As shown in FIG. 5, the upper cardboard sheet 21*a* and the lower cardboard sheet 21*b* are bonded with a double-faced adhesive sheet 27*b*.

The film 26 is bonded to the surface of the portion surrounding the medium holder 16. More specifically, with a double-faced adhesive sheet 27*a*, the film 26 is bonded to the surface of the portion of the upper cardboard sheet 21*a* surrounding the positioning hole 24 having the stamp face material 18 put therein, to cover the surface of the portion surrounding the medium holder 16.

The film 26 further covers the side surfaces 18*b* and the surface 18*a* of the stamp face material 18 exposed upward through the positioning hole 24, but is not bonded to those surfaces. Accordingly, after processing the stamp face material 18, the stamp face material 18 can be easily removed from the medium holder 16 by folding the lower cardboard sheet 21*b* backward along the perforation 25*a* shown in FIG. 4C and detaching the portion surrounded by the perforation 25 and the perforation 25*a* from the upper cardboard sheet 21*a*.

The principles of processing the face of a stamp by heating the surface of the porous EVA forming the stamp face material 18 with the thermal head are now described. First, containing numerous bubbles, porous EVA (hereinafter referred to simply as EVA) can be impregnated with liquid such as ink, like a sponge.

Also, EVA has thermoplasticity. Therefore, when EVA is heated to 70 to 120 degrees Celsius, the heated portion is softened, and the once-softened portion is hardened when cooled. The bubbles in the hardened portion disappear, and the hardened portion becomes a nonporous portion that is not to be impregnated with liquid such as ink.

When a portion of the surface of EVA is heated with the thermal head for approximately 1 to 5 milliseconds by taking advantage of the above described characteristics, the portion of the surface of EVA can be made nonporous, and ink can be prohibited from passing through the portion.

That is, in the stamp mark to be formed with the stamp to be produced, the portion through which ink is allowed to pass is not heated, and the portion through which ink is not allowed to pass is heated. In this manner, an ink permeation portion can be formed in accordance with the stamp mark.

If the heating treatment by the thermal head is substituted by a printing operation by a conventional thermal printer, the tone in the print data of the stamp mark is reversed. Also, as the stamp mark corresponds to the stamp face, the print data is mirror data of the stamp mark data created by the user.

Based on the principles, the tone of the surface of EVA is reversed and is selectively heated in accordance with a desired stamp mark, so that ink is prohibited from passing through the heated portion, and the ink inside can be pushed out in accordance with the stamp mark formed in the non-heated portion.

In the process of heating the EVA surface, the ink of course exudes from the non-heated portion. Therefore, the portion outside the stamp mark portion desired by the user should be heated so as not to allow the ink to exude therefrom.

However, it is unavoidable that the center position of the EVA is slightly shifted from a predetermined position on the center line of the thermal head due to an assembly error or the like in a mass production line. If such a situation continues, the ink leaks from a portion unintended by the user (such as an end portion of the EVA).

In a specific example, the stamp mark data created by the user is 30 mm×30 mm. The portion to be subjected to the heat treatment for the stamp mark data with the thermal head is also 30 mm×30 mm.

In a case where the position of the EVA is shifted in the scanning direction by 1 mm due to an assembly error, not only is the center of the stamp face shifted by 1 mm, but also the ink leaks from an end portion, since the 1-mm end portion is not heated.

So as to avoid such a situation, in the heating process using the thermal printer of this example, print data formed by adding solid-black print data to the peripheral portion of the stamp mark data edited by the user so as to set a heating margin area for prohibiting ink leakage is set as the data for stamp platemaking that actually involves the print data.

Therefore, when a medium holder for a stamp face size of 30 mm×30 mm is provided to the user, for example, the actual stamp face material size is (30+L)×(30+L) mm Here, L is 1 to 2 mm, for example.

The stamp mark data to be created and edited by the user is of course stamp mark data transferred onto a stamp object. Therefore, mirror data formed by mirror-reversing desired stamp mark data created by the user is actually used in platemaking performed on EVA.

To sum up, stamp mark data created and edited by the user is subjected to the processes of "tone reversal" and "mirror reversal", and the data generated by further adding solid-black data for the heating margin to the peripheral portion of the stamp data is the print data to be eventually input to the thermal head.

As the EVA surface is heated with the thermal head by using this print data, platemaking can be readily performed to process the stamp face material to have a stamp mark unique to the user. To remove the stamp face plate produced by processing the stamp face material from the medium holder 16, the lower cardboard sheet 21*b* is simply detached from the upper cardboard sheet 21*a* along the perforation 25 and the perforation 25*a* as described above.

EVA is a material that has a thickness of 1.5 mm, and also has high elasticity and a high friction coefficient. Therefore, when EVA is inserted into the thermal printer and is transported therein, the frictional force between the thermal head and the EVA is too large to carry out stable, straight transportation.

Specifically, EVA has a large frictional force and is as elastic as rubber. Therefore, even in a case where a guide for obtaining straight-running stability is attached to the thermal printer side, if the transportation path has even the slightest curve, the EVA is bent, immediately resulting in obliquity.

The problem with the EVA transportation occurs even in a case where the thermal head is not heated and is in a non-heated state. In a case where the thermal head is heated, the temperature of the thermal head rises almost to 200 degrees Celsius in several milliseconds after the start of the heating. Therefore, the surface is softened as soon as the EVA surface is heated, and the thermal head is buried in the softened portion and completely hinders the EVA transportation.

In a case where an edge head is used or where a carriage is incorporated so as to drive the head, the above described problem does not occur. By those methods, however, the mechanism becomes larger in size, and the costs of the components to be used are much higher, as described above.

In the present invention, the medium holder 16 shown in FIGS. 2 through 5 is used so as to perform platemaking to process a stamp face plate of EVA, which has the above described problem in transportation, in the printer 1 of this example using a conventional thermal head as shown in FIGS. 1, 2, 3A, and 3B, without any increase in the mechanism size and large increases in costs.

First, the four sides of the stamp face material 18 held in the positioning hole 24 of the medium holder 16 are cut by a thermal cutting device. With this, the ink inside will not exude from the four sides of the stamp face material 18.

The stamp face material 18 is positioned and secured by the positioning hole 24 of the upper cardboard sheet 21*a*, and is held by the lower cardboard sheet 21*b* from below while the upper surface is covered with the film 26. Accordingly, the stamp face material 18 is not deformed by any external force while being held in the medium holder 16.

Accordingly, the stamp face material 18 is transported just as the medium holder 16 is transported. If the medium holder 16 is transported in a straight line, the stamp face material 18 is also transported in the same straight line. The film 26 has heat resistance to higher temperatures than the melting point of the stamp face material 18 or EVA.

Accordingly, even if the surface of the stamp face material 18 is melted by heat from the thermal head 4, the film 26 is not melted. That is, the film 26 does not lose its coating properties. Also, the film 26 has a very small frictional force with respect to the thermal head 4.

By virtue of the coating properties of the film 26, the thermal head 4 is prevented from being buried in a melted and softened stamp face material 18. By virtue of the low frictional properties with respect to the film 26, the thermal head 4 can readily continue heat-generating printing (platemaking) along the surface of the film 26. In this manner, platemaking with the stamp face material 18 is completed.

Figure 6:
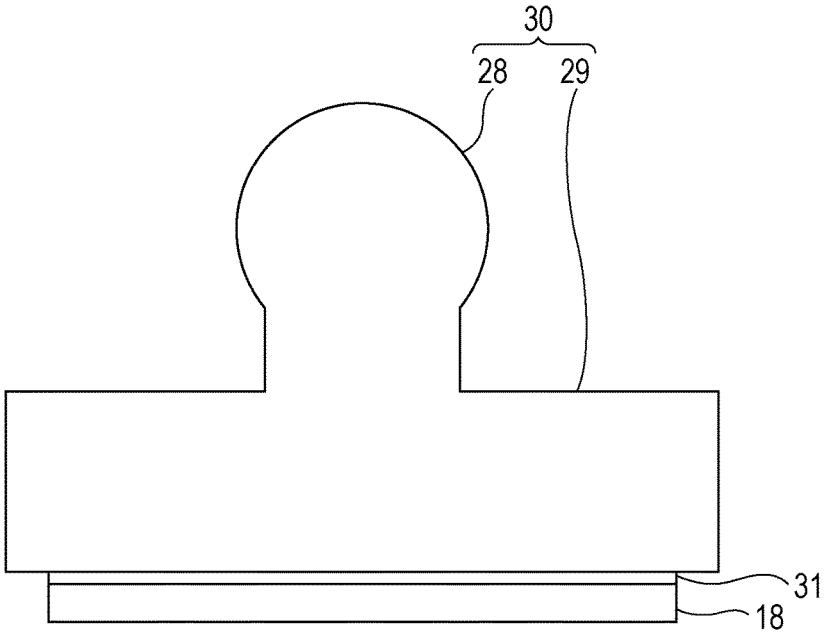
FIG. 6 is a diagram illustrating a situation where a stamp is completed by attaching the stamp face plate removed from the medium holder after the end of platemaking to the base of a stamp unit.

FIG. 6 is a diagram illustrating a situation where a stamp is completed by attaching the stamp face plate removed from the medium holder 16 after the end of platemaking to the base of a stamp unit. As shown in FIG. 6, the stamp face material 18 is bonded as a processed stamp face plate to the back surface of a base 30 by a double-faced adhesive sheet 31, with the stamp face facing downward. The base 30 is formed with a ball-like handle 28 and a pressing portion 29.

As the stamp face is immersed in ink for a certain period of time, the stamp face plate is impregnated with the ink. After wiping off extra ink on the stamp face, the user holds the handle 28 with fingers, and presses the pressing portion 29 against a stamp object. As a result, the ink inside is pushed out of the stamp face, and a stamp mark is formed.

Although the stamp face material 18 shown in FIG. 4A has a square shape, and the medium holder 16 shown in FIG. 4A has a rectangular shape, the shapes and the sizes of the respective components are not limited to those shown in FIG. 4A. As long as the medium holder 16 has such a width that can be inserted into the printer 1 shown in FIGS. 2, 3A, and 3B, the shape and the size of the medium holder 16 are appropriate. As long as the stamp face material 18 has such a size that can be held in the medium holder 16, the shape and the size of the stamp face material 18 are appropriate.

Referring back to FIG. 4A, the structure of the medium holder for enabling the control unit of the printer 1 to detect the size of the stamp face material that can have any shape and size, and the printing start position of the stamp face material is described. As shown in FIG. 4A, the medium holder 16 can show the three values of $\alpha$, $\beta$, and $\gamma$, by virtue of the existence of the predetermined pattern 32.

Here, a represents the length from the top end of the medium holder 16 in the inserting direction extending along the sensor scanning line 23 indicated by a dot-and-dash line to the start point of the predetermined pattern 32 (the start of the pattern), and the length of the stamp face material 18 can be expressed as "$(1/\alpha)\times a$" (a being a constant) or by a correspondence table of $\alpha$ and stamp face material lengths, for example.

$\beta$ represents the length from the start point to the end point of the predetermined pattern 32 (the end of the pattern), and the width of the stamp face material 18 can be expressed as "$\beta\times b$" (b being a constant) or by a correspondence table of $\beta$ and stamp face material widths, for example. $\gamma$ represents the length from the end point of the predetermined pattern 32 to the top end of the stamp face material 18, corresponds to the distance from the sensor 3 to the thermal head 4, and can indicate the printing start timing.

Using the sensor 3, the printer 1 senses the top end portion of the medium holder 16 on the sensor scanning line in the inserting direction and the start and end points of the predetermined pattern 32 along the sensor scanning line 23 indicated by a dot-and-dash line, and measures the lengths a and 13 from the step count of the stepping motor 12. The printer 1 calculates the vertical and horizontal sizes of the stamp face material 18 or obtains the vertical and horizontal sizes of the stamp face material 18 from the correspondence table in some cases, and acquires the printing start timing in other cases.

Figure 7:
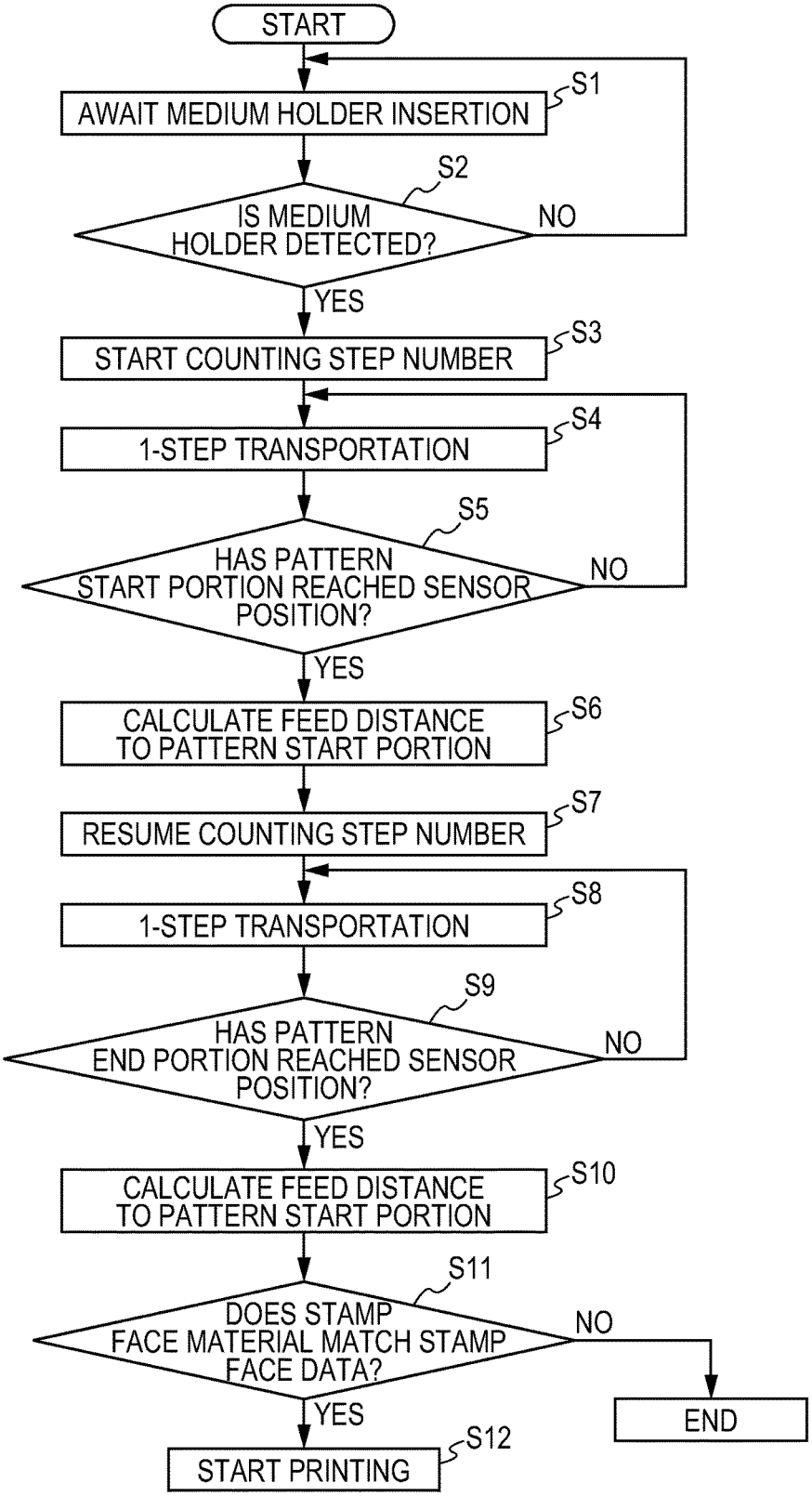
FIG. 7 is a flowchart for explaining a platemaking process to be performed by the central control circuit of the platemaking thermal printer according to the first embodiment.

FIG. 7 is a flowchart for explaining a platemaking process to be performed by the central control circuit 2 (hereinafter referred to simply as the control unit) of the printer 1. This process is started when the printer 1 is switched on, and stamp mark data is transmitted from the PC 14.

First, the control unit awaits insertion of the medium holder 16 through the printing medium inlet 15 (step S1). The control unit determines whether the top end of the medium holder 16 on the sensor scanning line has been detected by the sensor 3 (step S2). If the top end has not been detected (the determination result of step S2 is No), the control unit awaits top end detection.

If the top end of the medium holder 16 on the sensor scanning line has been detected by the sensor 3 (the determination result of step S2 is Yes), the control unit supplies a pulse signal to the stepping motor 12 via the motor driver 6 for rotary drive, and starts counting the number of steps of the pulse signal supplied to the stepping motor 12 (step S3). The control unit then rotates the stepping motor 12 by an amount equivalent to one step, to transport the medium holder 16 by a distance equivalent to the 1-step rotation (step S4).

The control unit then determines whether the pattern start point of the predetermined pattern 32 has reached the position of the sensor 3 (step S5). Although the predetermined pattern 32 is a solid-black printed portion in the example shown in FIG. 4C, the predetermined pattern may be any pattern that can be detected by the sensor 3. In view of this, in the flowchart shown in FIG. 7, the start portion (the start point) of the predetermined pattern 32 is referred to as "pattern start portion", and the end point of the predetermined pattern 32 is referred to as "pattern end portion".

If the pattern start portion has not reached the position of the sensor 3 (the determination result of step S5 is No) after the determination of step S5, the control unit returns to step S4, and repeats the procedures of steps S4 and S5.

When the sensor 3 detects that the pattern start portion of the predetermined pattern 32 has reached the position of the sensor 3 (the determination result of step S5 is Yes), the control unit calculates the transportation distance from the top end of the medium holder 16 on the sensor scanning line to the pattern start portion of the predetermined pattern 32 based on the counted number of steps of the stepping motor 12 (step S6). This calculation result is stored as a first transportation distance a into a storage area in a predetermined memory device via the memory control circuit 8.

The control unit then resumes the counting of the number of steps of the stepping motor 12 from 0 (step S7). The control unit then rotates the stepping motor 12 by an amount equivalent to one step, to transport the medium holder 16 by a distance equivalent to the 1-step rotation (step S8).

The control unit then determines whether the pattern end portion of the predetermined pattern 32 has reached the position of the sensor 3 (step S9). If the pattern end portion has not reached the position of the sensor 3 (the determination result of step S9 is No), the control unit returns to step S8, and repeats the procedures of steps S8 and S9.

When the sensor 3 detects that the pattern end portion of the predetermined pattern 32 has reached the position of the sensor 3 (the determination result of step S9 is Yes), the control unit calculates the transportation distance (the length of the predetermined pattern 32) from the start point (start portion) to the end point of the predetermined pattern 32 based on the counted number of steps of the stepping motor 12 (step S10). This calculation result is stored as a second transportation distance 13 into the storage area in the predetermined memory device via the memory control circuit 8.

At this point, the control unit reads the first transportation distance a stored in the memory device. The control unit then determines the length of the stamp face material 18 based on the predetermined expression "$(1/\alpha)\times a$" (a being a constant), for example, or the correspondence table of $\alpha$ and stamp face material lengths.

The control unit further reads the second transportation distance 13 stored in the memory device. The control unit then determines the width of the stamp face material 18 based on the predetermined expression "$\alpha\times b$" (b being a constant), for example, or the correspondence table of $\beta$ and stamp face material widths.

The control unit then determines whether the length and the width determined by subtracting the heating margin area from the above determined length and the above determined width of the stamp face material 18, respectively, are equal to the length and the width of the stamp mark data transmitted from the PC 14 (step S11). If the length and the width determined as above are equal to the length and the width of the stamp mark data (the determination result of step S11 is Yes), the control unit starts printing (step S12). When the printing is completed, the control unit ends the platemaking process.

Since the thermal head 4 is located immediately in front of the top end of the stamp face material 18 when the sensor 3 detects that the pattern end point of the predetermined pattern 32 has reached the position of the sensor 3, platemaking is started in the above printing process when the pattern end point is detected. In this platemaking, print data created by adding a predetermined heating margin area to each of the four sides of the stamp mark data transmitted from the PC 14 is used.

If the length and the width determined by subtracting the heating margin area from the above determined length and the above determined width of the stamp face material 18, respectively, are not equal to the length and the width of the stamp mark data transmitted from the PC 14 in the determination of step S11 (the determination result of step S11 is No), the control unit does not start a printing process, and instantly ends the platemaking process by displaying a mismatch error on the display device 13 or notifying the PC 14 of the error via the USB control circuit 10 or the like.

As described above, according to this embodiment of the present invention, the size of the stamp face material 18 held in the medium holder 16 can be accurately detected simply by changing the position and the length of the predetermined pattern 32 formed in one side of the medium holder 16 in accordance with the size of the stamp face material 18 to be held. With this structure, platemaking errors due to wrong stamp face material sizes set by users can be prevented.

Furthermore, the initial cost for this structure is only the cost of the cutting die for manufacturing the medium holder 16, and this structure can be realized at very low costs. For example, each type of cutting die is 50,000 to 100,000 yen, which is much more inexpensive than a metal mold for manufacturing molded products.

Second Embodiment

Modifications of the Predetermined Pattern (Solid-Black Printed Portion)

Figure 8A:
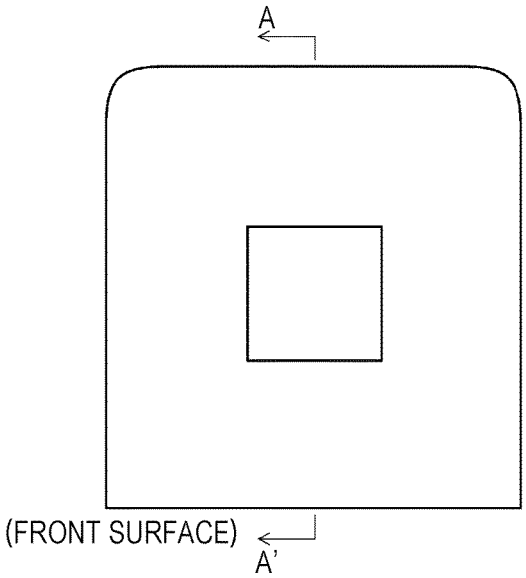
FIGS. 8A through 8D are diagrams showing the shape of a medium holder according to a second embodiment (modifications of the solid-black printed portion).
Figure 8B:
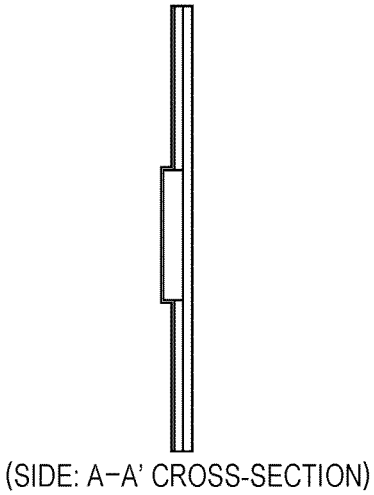
Figure 8C:
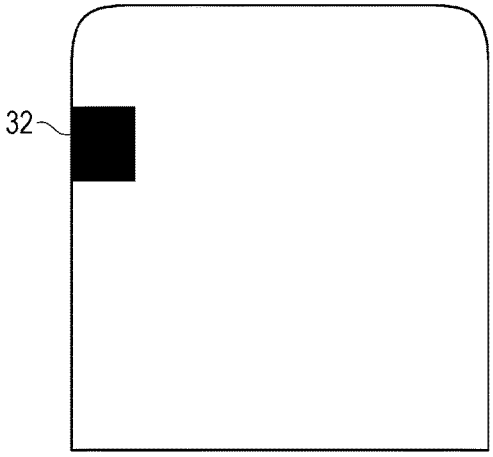
Figure 8D:
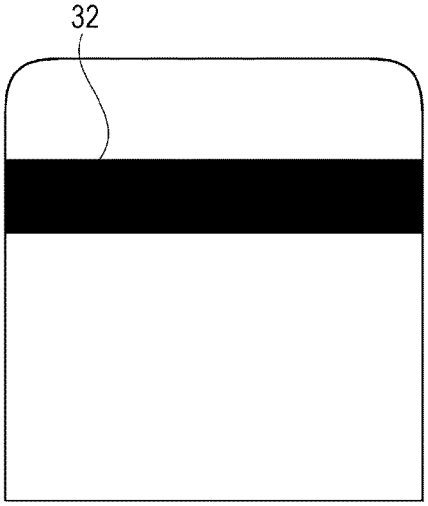

FIGS. 8A through 8D are diagrams showing medium holders according to a second embodiment (solid-black printed portions). FIG. 8A shows the surface of a medium holder or the side on which a stamp face material is to be placed. FIG. 8B is a cross-sectional view of the medium holder, taken along the A-A' line. FIGS. 8C and 8D each show the back surface of a medium holder. The second embodiment differs from the first embodiment in the print range of the solid-black printed portion, and the other aspects are the same as those of the first embodiment.

As shown in FIGS. 8C and 8D, in the second embodiment, a solid-black printed portion is provided in a much wider area than in the first embodiment on the back surface of a medium holder (an area that is wide in the direction perpendicular to the transporting direction, so as not to affect the detecting direction). In a case where the sensor 3 is an optical sensor, a solid-black printed portion printed in a wider area than a necessary range can also be sensed, as long as the solid-black printed portion functioning as the predetermined pattern 32 covers the necessary range.

The sensor 3 included in a thermal printer according to the present invention performs sensing based on a difference in intensity of reflected light. Accordingly, where a solid-black portion is printed on the back surface of a medium holder, the sensor 3 can sense the portion. In an example case where a solid-black portion is printed continuously in the direction perpendicular to the transporting direction of a medium holder as in FIG. 8D, the solid-black portion can be collectively printed on medium holders before a large plate is cut into the individual medium holders. Accordingly, very high manufacturing efficiency is achieved.

Specifically, on the back surface of a medium holder, a solid-black printed portion is formed in a position through which the sensor 3 for sensing the predetermined pattern 32 passes, as shown in FIG. 8C. Alternatively, a belt-like solid-black printed portion may be formed across the medium holder (in the direction perpendicular to the transporting direction), as shown in FIG. 8D.

<Structure of the Medium Holder>

In the above described first and second embodiments, the medium holder is formed with two cardboard sheets, but the present invention is not limited to that. The medium holder may be formed with one cardboard sheet, and a positioning concave portion for positioning and securing the stamp face material may be formed. Instead of a hole or a concave portion, claws or the like may be formed, as long as the stamp face material can be secured in one position at the time of platemaking. Also, an adhesive material may be applied to the four corners or two corners of the back surface of the stamp face material so that the stamp face material can be detachably secured in one position.

The material of the medium holder is not necessarily the coated cardboard described in the above embodiments, but may be any appropriate material, as long as the stamp face material can be secured in one position and be transported in a stable manner at the time of platemaking.

Further, the film that covers the surface of the medium holder does not necessarily cover the entire surface of the medium holder as in the above embodiments, but may cover only part of the stamp face material or part of the portion surrounding the stamp face material, as long as the stamp face material can be secured in one position and be transported in a stable manner at the time of platemaking. In the above embodiments, the film is bonded to the entire surface of the portion of the medium holder surrounding the stamp face material with a double-faced adhesive sheet. However, the present invention is not limited to that. For example, while the film on the first half of the medium holder in terms of the transporting direction is bonded to the surface of the portion surrounding the stamp face material with a double-faced adhesive sheet, the film on the second half of the medium holder may cover the surface but may not be bonded to the surface so that the stamp face material can be repeatedly attached and detached.

<Medium Holder Manufacturing Method>

As for the above described medium holder, the manufacturing method includes the step of processing cardboard sheets so that a stamp face material can be attached to the medium holder (a cardboard processing step), and the step of bonding a film to the stamp face material, to cover the stamp face material (a film bonding step). The step of forming the predetermined pattern, which is a feature of the present invention, on the back surface of the medium holder (a pattern printing step) can be carried out by printing.

There are three ways to carry out the pattern printing step.

In a first case, the pattern printing step is carried out before the cardboard processing step. In this case, printing is performed in a relatively large area on a cardboard sheet, and the sheet is divided into individual medium holders to be processed so that stamp face materials can be attached thereto (the cardboard processing step). After that, the film bonding step is carried out, to complete a medium holder. A stamp face material is attached to the medium holder, and the medium holder can be used in the above described stamp-face platemaking device.

In a second case, the pattern printing step is carried out between the cardboard processing step and the film bonding step. In this case, printing is performed after individual medium holders are separated from one another. Therefore, printing is performed in relatively small areas.

In a third case, the pattern printing step is carried out after the film bonding step. In this case, the user of the stamp-face platemaking device can attach a stamp face material to a general medium holder, and print information about the size and the position of the stamp face material on the back surface of the medium holder immediately before stamp-face platemaking. In this case, the necessary measure is taken to protect the already attached film.

Although embodiments of the present invention have been described so far, the present invention also includes the claimed inventions and equivalents thereof.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

The invention claimed is:

1. A stamp-face platemaking device capable of performing platemaking of a stamp face on stamp face materials of various sizes, the stamp-face platemaking device comprising:

a plate insertion portion;

a single sensor configured to detect at least two positions from among: a position of a top end portion of a medium holder on a sensor scanning line in an inserting direction, a position of one pattern end portion of a printing pattern printed on the medium holder on the sensor scanning line, and a position of the other pattern end portion of the printing pattern printed on the medium holder on the sensor scanning line, when the medium holder is inserted into the plate insertion portion, wherein the medium holder includes: a stamp face material capable of being made nonporous by being heated, and a holding unit configured to hold the stamp face material and provided with, at a side end portion thereof, the printing pattern that varies in accordance with a size of the held stamp face material;

a processor configured to set the size of the held stamp face material based on a distance between at least two of the positions detected by the sensor;

a platemaking unit configured to perform platemaking of the stamp face by heating the held stamp face material within the size of the stamp face material set by the processor; and a memory configured to store an image for platemaking;

wherein the processor is configured to read the image for platemaking from the memory, and to determine whether a size of the image for platemaking is the same size as the set size of the stamp face material; and wherein the processor is configured to conduct the platemaking on the stamp face material when the size of the image for platemaking is determined to be the same size as the set size of the stamp face material, and the processor is configured not to conduct the platemaking on the stamp face material and to notify of a size mismatch when the size of the image for platemaking is determined not to be the same size as the set size of the stamp face material.

2. The stamp-face platemaking device according to claim 1, wherein the processor sets the size of the held stamp face material in accordance with a predetermined correspondence table that is based on the distance between the at least two of the positions detected by the sensor.

3. The stamp-face platemaking device according to claim 1, wherein the processor is configured to start the platemaking on the stamp face material based on the position of the other pattern end portion of the printing pattern detected by the sensor.

4. The stamp-face platemaking device according to claim 1, wherein the sensor is an optical sensor placed in a position corresponding to the side end portion of the holding unit in the medium holder.

5. The stamp-face platemaking device according to claim 1, wherein the sensor detects the printing pattern printed on a back surface of the medium holder.

6. A platemaking method for a stamp-face platemaking device capable of performing platemaking of a stamp face on stamp face materials of various sizes, the platemaking method comprising:

detecting at least two positions by a single sensor from among: a position of a top end portion of a medium holder on a sensor scanning line in an inserting direction, a position of one end portion of a printing pattern printed on the medium holder on the sensor scanning line, and a position of the other end portion of the printing pattern printed on the medium holder on the sensor scanning line, when the medium holder is inserted into a plate insertion portion, wherein the medium holder includes a stamp face material capable of being made nonporous by being heated, and a holding unit configured to hold the stamp face material and provided with, at a side end portion thereof, the printing pattern that varies in accordance with a size of the held stamp face material;

setting the size of the held stamp face material based on a distance between at least two of the detected positions;

reading an image for platemaking from a storage unit, and determining whether a size of the image for platemaking is the same size as the set size of the stamp face material; and conducting stamp-face platemaking on the stamp face material by heating the held stamp face material within the set size of the stamp face material when the size of the image for platemaking is determined to be the same size as the set size of the stamp face material, and notifying of a size mismatch without conducting the stamp-face platemaking on the stamp face material when the size of the image for platemaking is determined not to be the same size as the set size of the stamp face material.

7. The platemaking method for the stamp-face platemaking device according to claim 6, further comprising starting the stamp-face platemaking on the stamp face material based on the detected position of the other end portion of the printing pattern.

* * * * *